US007800603B2

(12) United States Patent
Wang et al.

(10) Patent No.: US 7,800,603 B2
(45) Date of Patent: Sep. 21, 2010

(54) LIQUID CRYSTAL DISPLAY PANEL WITH PHOTO SENSORS AND METHOD FOR ADJUSTING REFERENCE VOLTAGE IN THE PANEL

(75) Inventors: Shih-Hsin Wang, Miao-Li (TW); Ti-Kai Chao, Miao-Li (TW)

(73) Assignee: Chimei Innolux Corporation, Miao-Li County (TW)

( * ) Notice: Subject to any disclaimer, the term of this patent is extended or adjusted under 35 U.S.C. 154(b) by 946 days.

(21) Appl. No.: 11/641,414

(22) Filed: Dec. 18, 2006

(65) Prior Publication Data

US 2007/0139343 A1 Jun. 21, 2007

(30) Foreign Application Priority Data

Dec. 16, 2005 (TW) ..... 94144821 A

(51) Int. Cl.
*G09G 5/00* (2006.01)

(52) U.S. Cl. ..... 345/207; 345/204; 356/221; 356/222; 356/229; 702/107

(58) Field of Classification Search ..... 345/204, 345/207; 702/107; 356/221, 222, 229
See application file for complete search history.

(56) References Cited

U.S. PATENT DOCUMENTS 6,141,092 A * 10/2000 Kim ..... 356/214
6,822,642 B2 11/2004 Chou
7,502,006 B2 * 3/2009 Aoki ..... 345/96
7,633,550 B1 * 12/2009 Starr et al. ..... 348/497
2001/0015725 A1 * 8/2001 Nakanishi et al. ..... 345/207
2003/0063074 A1 * 4/2003 Kumagawa et al. ..... 345/204
2003/0098835 A1 * 5/2003 O'Donnell et al. ..... 345/87
2006/0145986 A1 * 7/2006 Oh et al. ..... 345/92

FOREIGN PATENT DOCUMENTS

CN 031198290 9/2004
JP 05249433 A * 9/1993

* cited by examiner

*Primary Examiner*—Richard Hjerpe
*Assistant Examiner*—Gregory J Tryder
(74) *Attorney, Agent, or Firm*—Wei Te Chung

(57) ABSTRACT

An exemplary liquid crystal display (LCD) panel includes scan lines, data lines, a scan driver connected to the scan lines, a data driver connected to the data lines, a controller connected to the scan driver and the data driver, and pixels formed by the scan lines and the data lines. The LCD panel is divided into five detecting regions, and the first detecting region is in a center of the LCD panel, and others surround the center portion of the LCD panel. Each detecting region includes a photo sensor. The controller is used to control the five detecting regions to have substantially the same flicker level.

11 Claims, 1 Drawing Sheet

LIQUID CRYSTAL DISPLAY PANEL WITH PHOTO SENSORS AND METHOD FOR ADJUSTING REFERENCE VOLTAGE IN THE PANEL

BACKGROUND OF THE INVENTION

1. Field of the Invention

The present invention relates to a liquid crystal display (LCD) panel and a method for adjusting voltage applied in the LCD panel; and particularly to an LCD panel with a reduced flicker effect, and a method for adjusting voltage applied in the LCD panel in order to reduce or even eliminate any flicker effect.

2. General Background

Generally, one well-known major disadvantage of cathode ray tube (CRT) monitors is the flicker problem. Liquid crystal display (LCD) monitors can also exhibit the flicker problem. In practice, a user is liable to be inconvenienced or annoyed by the flicker problem no matter which kind of monitor he or she has.

The reason for the occurrence of the flicker problem in an LCD monitor is as follows. To illustrate why an LCD panel flickers, suppose that a manufactured LCD panel has a common voltage (Vcom) of 5.5V according to its specifications. If an input video signal varies between 0V and 10V, the full-scale voltage applied to different electric fields of the pixel-based graphic display varies accordingly. In one field, the full-scale voltage may be 4.5V; and in another field, the full-scale voltage may be 5.5V. This difference in full-scale voltage translates to a difference in light intensity, which is perceived as flicker by a viewer.

In mass manufacturing, due to the variations in the construction of each LCD panel, the optimal Vcom voltage can differ from LCD panel to LCD panel or even across a single LCD panel. Original equipment manufacturers must therefore adjust each of the LCD panels coming out of the factory to eliminate flicker. For small LCD screens where the backplane of the LCD panel can be considered as a low-impedance ground, a single potentiometer can be connected to the LCD panel for adjustment of the common voltage. Traditionally, the potentiometer is manually connected to the LCD panel, and the adjustment is performed by a human operator. However, this procedure has low precision, and the LCD panel is liable to be accidentally damaged by the operator. In addition, the procedure is generally only suitable for small LCD panels. Furthermore, due to human error in viewing the displayed image, the flicker problem may still occur in the LCD panel even after meticulous adjustment by the operator.

What is needed, therefore, is a liquid crystal display panel and a method for adjusting voltage applied in a liquid crystal display panel which can overcome the above-described problems.

SUMMARY

An exemplary of liquid crystal display panel (LCD) includes a plurality of scan lines, a plurality of data lines, a scan driver, a data driver, a timing controller, and a common electrode. The scan lines and the data lines cross each other and form a crisscross matrix which defines a plurality of pixels. Both of the data and scan drivers are used to drive the pixels. The controller electrically connects to the scan driver and the data driver. The LCD panel defines a first detecting area and a second detecting area. The first detecting area is located in a center portion of the LCD panel and the second detecting area is located in a portion of LCD panel other than the center portion. Each of the first and second detecting area includes a photo sensor (e.g. a photonic diode or a photonic transistor, etc.). By comparing a flicker level of the first detecting area and a minimum value of the flicker level of the second detecting area through the photo sensors so as to adjust a voltage applied to the common electrode through the timing controller. Therefore, the flicker problem can be substantially eliminated.

An exemplary of method for adjusting voltage applied in an LCD panel is also provided. The LCD panel includes a first detecting area and a second detecting area where the first detecting area is located in a center portion of the LCD panel and the second detecting area is located in a portion other than the center portion of the LCD panel. The method includes the following steps: (a) detecting a brightness of the at least one first detecting area and a brightness of the second detecting area; (b) transforming each of the brightnesses of the at least one first detecting area and the second detecting area to an analog signal; (c) obtaining at least one minimum value of first flicker level from the at least one first detecting area and a second flicker level from the second detecting area; (d) comparing the at least one minimum value of first flicker level and the second flicker level; (e) adjusting a voltage of the common electrode of said LCD panel if any one of the at least one minimum value of first flicker level is not equal to the second flicker level; and (f) fixing a voltage of the common electrode of said LCD panel if each of the at least one minimum value of first flicker level is substantially equal to the second flicker level.

Other advantages and novel features of embodiments of the present invention will become more apparent from the following detailed description when taken in conjunction with the accompanying drawings.

DETAILED DESCRIPTION OF PREFERRED EMBODIMENTS

Figure 1:
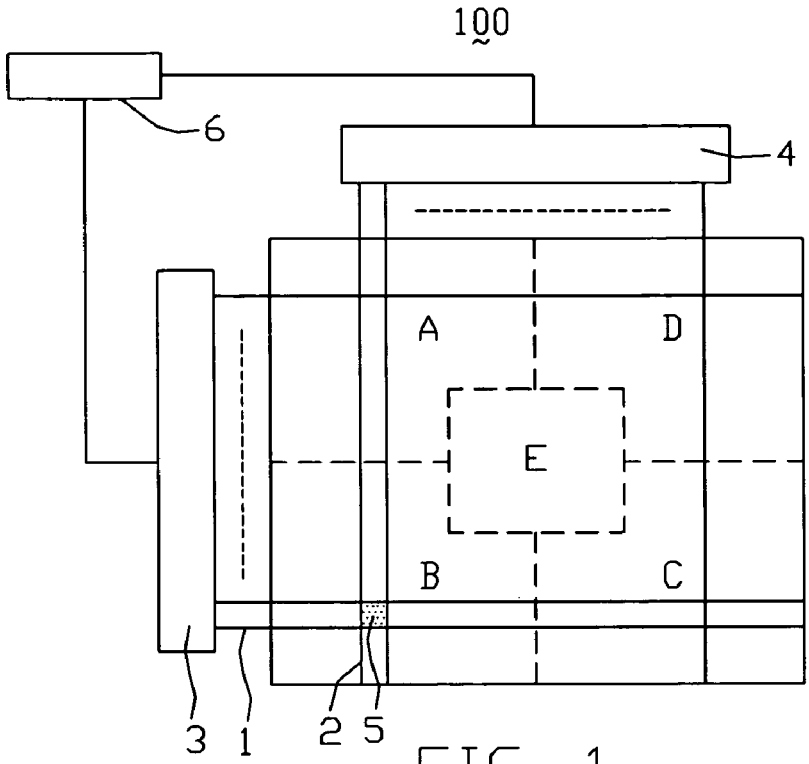
FIG. 1 is an abbreviated block diagram of a liquid crystal display panel according to an exemplary embodiment of the present invention.

Referring to FIG. 1, this is an abbreviated block diagram of a liquid crystal display (LCD) panel according to an exemplary embodiment of the present invention. The LCD panel 100 includes a plurality of parallel scan lines 1, a plurality of parallel data lines 2, a scan driver 3, a data driver 4, a timing controller 6 connecting to both the scan driver 3 and the data driver 4, and a common electrode (not shown). The scan lines 1 and the data lines 2 cross each other and form a crisscross matrix, which defines a plurality of pixels 5. The scan driver 3 and data driver 4 are connected to the plurality of scan lines 1 and the plurality of data lines 2 respectively, so as to drive the pixels 5 to display images. In the preferred embodiment, each pixel 5 has a photo sensor (not shown) such as a photonic diode or a photonic transistor. The photo sensor can be embedded in each pixel 5 during a semiconductor manufacturing process.

In the preferred embodiment, the LCD panel 100 can be divided into five detecting areas. The first detecting area E is located in a center portion of the LCD panel 100, and other four areas (a second detecting area A, a third detecting area B, a fourth detecting area C, and a fifth detecting area D) surround the first detecting area E. The timing controller 6 is used to compare a minimum value of flicker level of each of the four detecting areas A, B, C, D to the flicker level of the first detecting area E. When one of the minimum values of flicker level (i.e. A or B or C or D) is different from the flicker level of the first detecting area E, a reference voltage of the common electrode is adjusted accordingly to eliminate the difference. If all of the minimum values of flicker level are identical to the flicker level of the first detecting area E, the reference voltage of the common electrode is fixed at its current (optimum) value. With the reference voltage fixed at the optimum value, all flicker levels over the whole LCD panel 100 should be identical.

Figure 2:
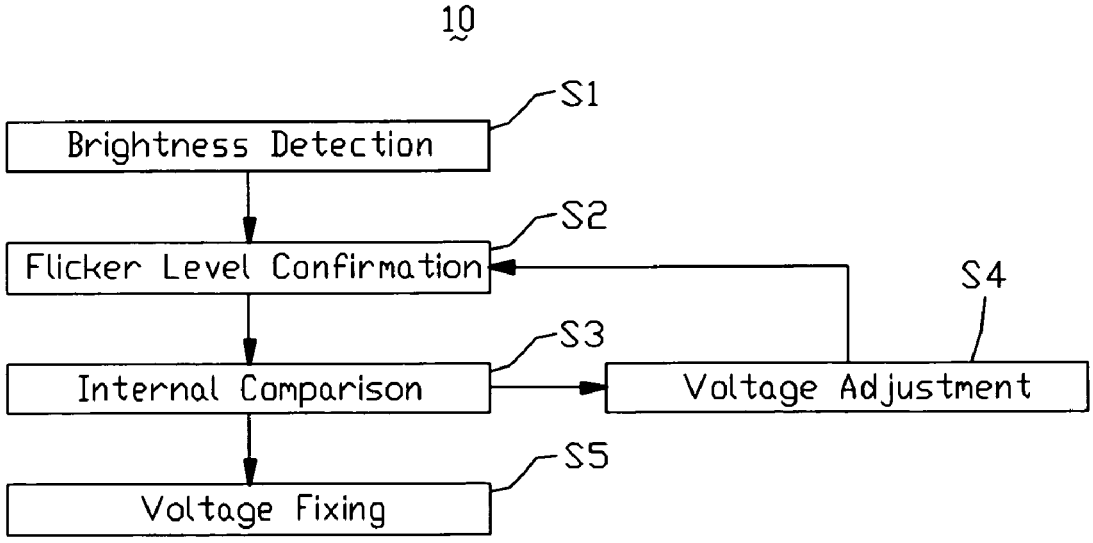
FIG. 2 is a flowchart of a method for adjusting voltage applied in a liquid crystal display panel, according to another exemplary embodiment of the present invention.

FIG. 2 is a flowchart 10 of a method for adjusting voltage applied in an LCD panel, according to another exemplary embodiment of the present invention. In the method, flicker levels of each of pixels are measured, flicker levels from different locations on the LCD panel 100 are compared, and then an optimized common electrode voltage is calculated. The method includes the following steps:

Step S1: detecting a brightness of the first, second, third, fourth, and fifth detecting areas E, A, B, C, and D sequentially. Subsequently, the brightness data of each of the detecting areas E, A, B, C, D is transformed to a corresponding analog signal. Step S2: obtaining flicker levels e, a, b, c, and d from the corresponding first, second, third, fourth, and fifth detecting areas. Step S3: comparing variations between the flicker levels e and a, e and b, e and c, e and d by means of internal logic pre-stored in the timing controller 6 of the LCD panel 100. If each of minimum values of the flicker levels a, b, c, or d is not equal to the flicker level e, step S4 is carried out; otherwise, step S4 is skipped. Step S4: adjusting the reference voltage applied to the common electrode of the LCD panel 100 with a view to equalizing the above-described flicker levels. Then steps S1 to S3 are repeated. Steps S4 and S1 to S3 are repeated in this way as many times as needed until every minimum value of the flicker levels a, b, c, and d is equal to the flicker level e. Step S5: fixing the current reference voltage of the common electrode as the optimum value when all the minimum values of the flicker levels a, b, c, and d are equal to the flicker level e.

It is to be noted that in Step S1, the analog signals are transformed from the brightness data of the detecting areas E, A, B, C, and D. In practice, the greater an analog signal, the greater the corresponding flicker level; and vice versa. In the preferred embodiment, the $127^{th}$ gray level is adopted to represent a standard level of brightness of each of the five detecting areas E, A, B, C, and D among gray level gradations from 0 to 255. This is because the middle gray level is more easily recognized by the human eye.

It is to be further understood that even though numerous characteristics and advantages of various embodiments have been set forth in the foregoing description, together with details of structures and functions of certain embodiments, the disclosure is illustrative only, and changes may be made in detail, including in matters of shape, size, and arrangement of parts within the principles of the invention to the full extent indicated by the broad general meaning of the terms in which the appended claims are expressed.

We claim:

1. A liquid crystal display (LCD) panel, comprising:

a plurality of scan lines;

a plurality of data lines, said scan lines and said data lines being arranged in a matrix thereby defining a plurality of pixels;

a scan driver driving said scan lines;

a data driver driving said data lines, said data driver and said scan driver configured to drive said pixels;

a controller connected to said scan driver and said data driver; and a common electrode;

wherein said LCD panel defines a plurality of first detecting areas and a second detecting area, the second detecting area is located in a center portion of said LCD panel and the first detecting areas are located in portions of said LCD panel other than the center portion, and each of the first detecting areas and the second detecting area comprises a photo sensor; and when a reference voltage is applied to said common electrode through said controller, said photo sensors detect a minimum value of flicker levels of the first detecting areas and a flicker level of the second detecting area, and said controller compares the minimum value of flicker levels of the first detecting areas with the flicker level of the second detecting area, and when the minimum value of flicker levels of the first detecting areas is unequal to the flicker level of the second detecting area, said controller adjusts the reference voltage applied to said common electrode until a current detected minimum value of flicker levels of the first detecting areas becomes substantially equal to a current flicker level of the second detecting area.

2. The liquid crystal display panel as claimed in claim 1, wherein said photo sensor is a photonic diode.

3. The liquid crystal display panel as claimed in claim 1, wherein said photo sensor is a photonic transistor.

4. The liquid crystal display panel as claimed in claim 1, wherein said controller is further configured to fix a current reference voltage applied to said common electrode when the current detected minimum value of flicker levels of the first detecting areas is substantially equal to the current flicker level of the second detecting area.

5. The liquid crystal display panel as claimed in claim 1, wherein when said controller adjusts the reference voltage applied to said common electrode, said controller repeatedly compares the current detected minimum value of flicker levels of the first detecting areas with the current flicker level of the second detecting area, and rejudges whether the reference voltage applied to said common electrode is to be adjusted according to the comparison result.

6. A method for adjusting voltage applied in a liquid crystal display (LCD) panel, said LCD panel comprising a common electrode, a plurality of first detecting areas, and a second detecting area, wherein the second detecting area is located in a center portion of said LCD panel and the plurality of first detecting areas are located in portions of said LCD panel other than the center portion, the method comprising:

(a) providing a reference voltage to the common electrode of the LCD panel;

(b) detecting a brightness of each of the plurality of first detecting areas and a brightness of the second detecting area;

(c) transforming each of the brightnesses of the plurality of first detecting areas and the second detecting area to corresponding analog signals;

(d) obtaining a minimum value of first flicker levels from the plurality of first detecting areas and a second flicker level from the second detecting area;

(e) comparing the minimum value of first flicker levels and the second flicker level;

(f) adjusting the reference voltage of the common electrode of said LCD panel if the minimum value of first flicker levels is not equal to the second flicker level; and (g) repeating steps (b) through (e) until a current minimum value of current first flicker levels is equal to a current second flicker level, and fixing a current reference voltage of the common electrode of said LCD panel.

7. The method as claimed in claim 6, wherein said LCD panel employs gray level gradations, and the brightnesses detected are with reference to a standard level of brightness that is a medium-range gray level in the gray level gradations.

8. The method as claimed in claim 7, wherein the medium-range gray level in the gray level gradations is a $127^{th}$ gray level among gray level gradations from 0 to 255.

9. The method as claimed in claim 6, wherein the brightnesses of said LCD panel are detected by at least one photonic diode.

10. The method as claimed in claim 6, wherein the brightnesses of said LCD panel are detected by at least one photonic transistor.

11. A liquid crystal display (LCD) panel, comprising:

a plurality of scan lines;

a plurality of data lines, said scan lines and said data lines being arranged in a matrix thereby defining a plurality of pixels;

a scan driver driving said scan lines;

a data driver driving said data lines, said data driver and said scan driver being used to drive said pixels;

a controller connected to said scan driver and said data driver; and a common electrode;

wherein said LCD panel defines a plurality of first detecting areas and a second detecting area, the second detecting area defines a smaller distance to a center of said LCD panel than the first detecting areas, and each of the first detecting areas and the second detecting area comprises a photo sensor; and when a voltage is applied to said common electrode through said controller, said photo sensors detect a minimum value of flicker levels of the first detecting areas and a flicker level of the second detecting area, and said controller compares the minimum value of flicker levels of the first detecting areas with the flicker level of the second detecting area, and when the minimum value of flicker levels of the first detecting areas is unequal to the flicker level of the second detecting area, the controller adjusts the voltage applied to said common electrode until a current detected minimum value of flicker levels of the at least one first detecting areas becomes substantially equal to a current flicker level of the second detecting area.

* * * * *